US006203379B1

(12) United States Patent
Cai et al.

(10) Patent No.: US 6,203,379 B1
(45) Date of Patent: Mar. 20, 2001

(54) SPACER FOR MODULAR JACK ASSEMBLY

(75) Inventors: Shemin Cai; ShaoPing Du, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/471,536

(22) Filed: Dec. 22, 1999

(51) Int. Cl.[7] ..... H01R 23/02
(52) U.S. Cl. ..... 439/676
(58) Field of Search ..... 439/676, 701, 439/941

(56) References Cited

U.S. PATENT DOCUMENTS 4,202,593 * 5/1980 Abernethy et al. ..... 339/125
4,221,458 * 9/1980 Hughes et al. ..... 339/126
4,231,628 * 11/1980 Hughes et al. ..... 339/17
4,556,264 * 12/1985 Tanaka ..... 339/17
4,606,595 * 8/1986 Dola ..... 339/99
4,699,595 * 10/1987 Nakazawa et al. ..... 439/676
5,011,435 * 4/1991 Seong et al. ..... 439/676
5,879,199 * 3/1999 Belopolsky ..... 439/701
5,975,943 * 11/1999 Chou et al. ..... 439/490
6,012,953 * 1/2000 Francis ..... 439/676

* cited by examiner

*Primary Examiner*—Brian Sircus
*Assistant Examiner*—Thanh-Tam Le
(74) *Attorney, Agent, or Firm*—Wei Te Chung

(57) ABSTRACT

An insert module for an electrical connector includes a spacer and contacts loaded therein. Clearance holes are defined through the spacer and horizontal holes are defined in a front end portion of the spacer in communication with the clearance holes. Receiving holes are defined in a bottom surface of the spacer in communication with the clearance holes and the horizontal holes. A contact in an initial straight shape is inserted into and through the horizontal hole for being upwardly and downwardly bent to respectively form a slanted spring contact portion and a right-angle bent tail portion received in the receiving hole. The clearance holes facilitate the downward bending of the contacts.

15 Claims, 6 Drawing Sheets

SPACER FOR MODULAR JACK ASSEMBLY

BACKGROUND OF THE INVENTION

1. Field of the Invention

The present invention relates to a modular jack, and particularly to a multi-port modular jack assembly having a spacer with contacts loaded therein.

2. Description of Prior Art

Modular jacks are commonly used for signal transmission. Some computing equipment is accessed by a plurality of devices and therefore has a plurality of modular jacks. In order to reduce production cost and occupied space, these modular jacks have been integrated in a single insulative housing in a juxtaposed manner for being mounted on a printed circuit board (PCB). Due to the high signal transmission speed required by many computers today, such multi-port modular jack assembly is also provided with a shield enclosing external surfaces of the integral housing. Each port of the housing receives an insert module with a plurality of contacts retained therein.

In the conventional designs, the contacts are integrally insert molded with insulative materials to form an insert module. The insert module provides latches on opposite sides thereof for interlocking with the housing. However, such a method results in increased cost and complicated assembling process thereby prohibiting mass production.

Therefore, a multi-port modular jack assembly with reduced cost and simplified assembling process is desired for facilitating mass production.

SUMMARY OF THE INVENTION

Accordingly, a main object of the present invention is to provide a multi-port modular jack assembly having a spacer with contacts loaded therein to reduce cost and facilitate mass production.

In order to achieve the object set forth, a multi-port modular jack assembly in accordance with the present invention comprises an insulative housing with a plurality of insert modules retained in chambers thereof and a plurality of LEDs assembled thereto by lockers. A shield for enclosing the housing has an extension plate adapted to downwardly overlap side plates thereof to enclose a rear end of the housing. The insert module includes a spacer with a plurality of contacts loaded therein.

The spacer is engaged with the housing and defines a plurality of clearance holes arranged in two rows. Each hole of the first row is staggered from a corresponding hole of the second row. A plurality of horizontal holes is defined in a front end portion of the spacer in communication with the corresponding clearance holes. Receiving holes are defined in the bottom surface of the spacer between the clearance holes and the horizontal holes. A contact in an initial straight shape is inserted into and through the horizontal hole for being upwardly and downwardly bent to respectively form a slanted spring contact portion and a right-angle bent tail portion received in the receiving hole. The clearance holes facilitate the downward bending of the contacts.

Other objects, advantages and novel features of the invention will become more apparent from the following detailed description when taken in conjunction with the accompanying drawings.

DETAILED DESCRIPTION OF THE INVENTION

Figure 1:
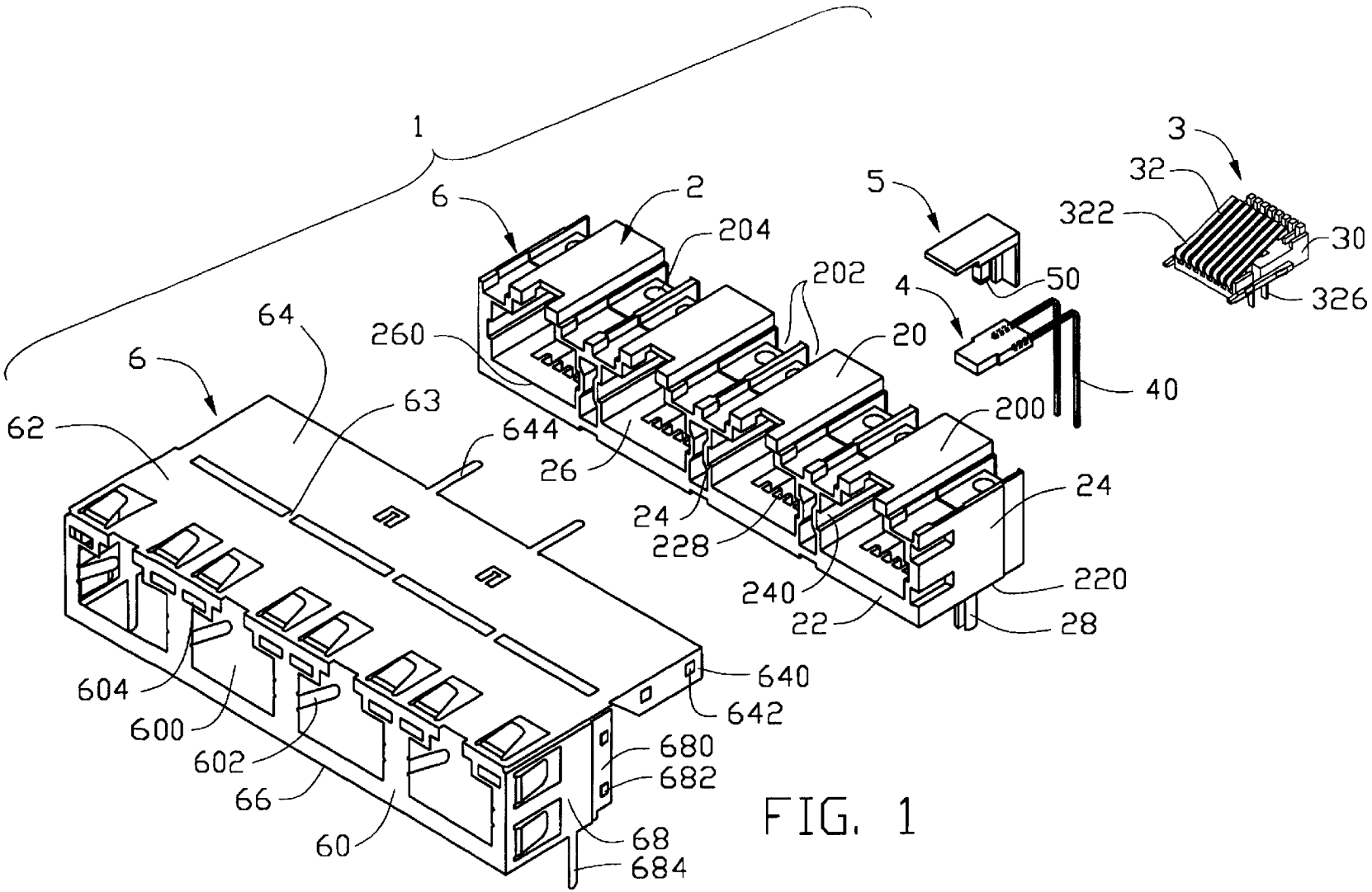
FIG. 1 is an exploded view of a multi-port modular jack assembly in accordance with the present invention.

Reference will now be made to the drawing figures to describe the present invention in detail.

Referring to FIG. 1, a multi-port modular jack assembly 1 in accordance with the present invention is shown and includes a 4-port modular jack assembly in this preferred embodiment. The modular jack assembly 1 comprises an insulative housing 2, four insert modules 3 (only one shown for simplicity) to be received in the housing 2 in a juxtaposed manner, a plurality of LEDs 4 (Light Emitting Diodes) (only one shown for simplicity) attached to the housing 2 by lockers 5 (only one shown for simplicity) for indicating electrical connection states, and a shield 6 enclosing the housing 2 for EMI/RFI shielding. The insert module 3 includes a spacer 30 and a plurality of contacts 32 loaded in the spacer 30.

The housing 2 is integrally molded of insulative material, such as thermoplastic polymer. The housing 2 has a top wall 20, a bottom wall 22 and a plurality of lateral walls 24 to cooperatively define four plug receiving chambers 26 therebetween. A pair of boardlocks 28 (only one visible) downwardly extends from a bottom surface 220 of the housing 2 proximate lateral sides thereof for fixedly attaching the housing 2 to a PCB (not shown). A plurality of grooves 202 is defined in a top surface 200 of the top wall 20 and downwardly extends to the rear end of the housing 2 for accommodating the LEDs 4 therein. Each LED 4 has a pair of terminals 40 extending along the groove 202 to be inserted into corresponding holes (not shown) in the PCB. An engaging hole 204 is defined in the bottom of each groove 202 for engaging a peg 50 of the locker 5 thereby retaining the LED 4 in position.

Figure 2:
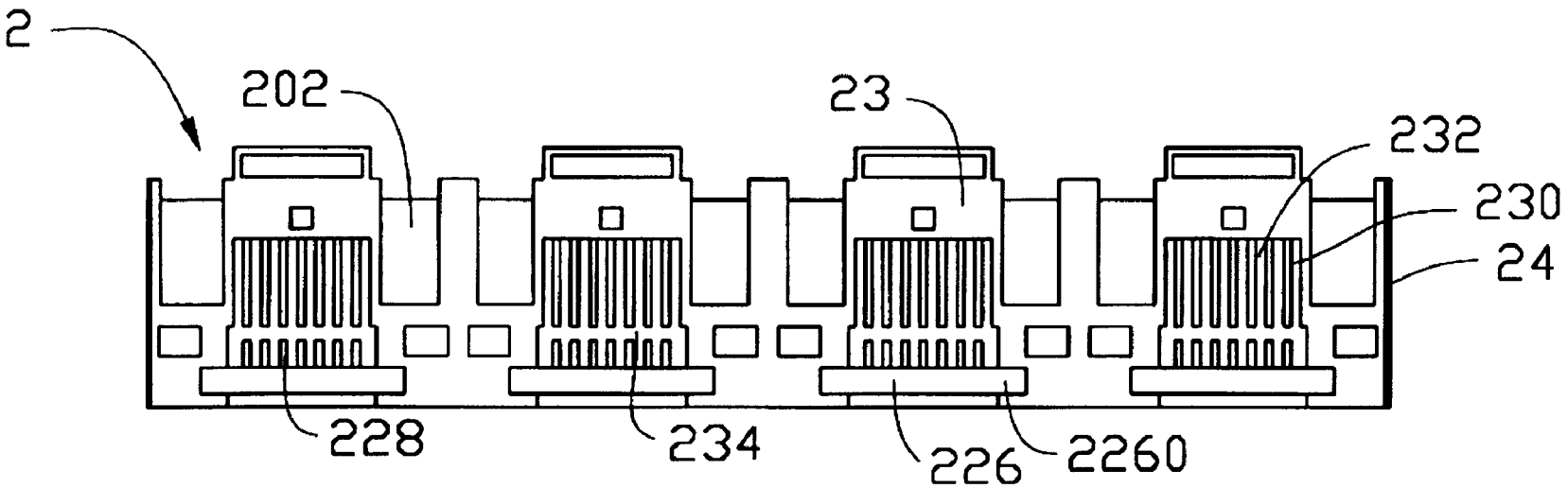
FIG. 2 is a rear view of the housing shown in FIG. 1.

Also referring to FIG. 2, each plug receiving chamber 26 has a front opening 260 for allowing insertion of a complementary modular plug (not shown), and a rear wall section 23 between opposed lateral walls 24 and perpendicular to the top and bottom walls 20, 22 but disposed centrally therebetween. The rear wall section 23 has a plurality of downwardly extending first partitions 230 with a plurality of receiving channels 232 defined therebetween. Each lateral wall 24 defines a recess 240 in an inner surface thereof.

Figure 3:
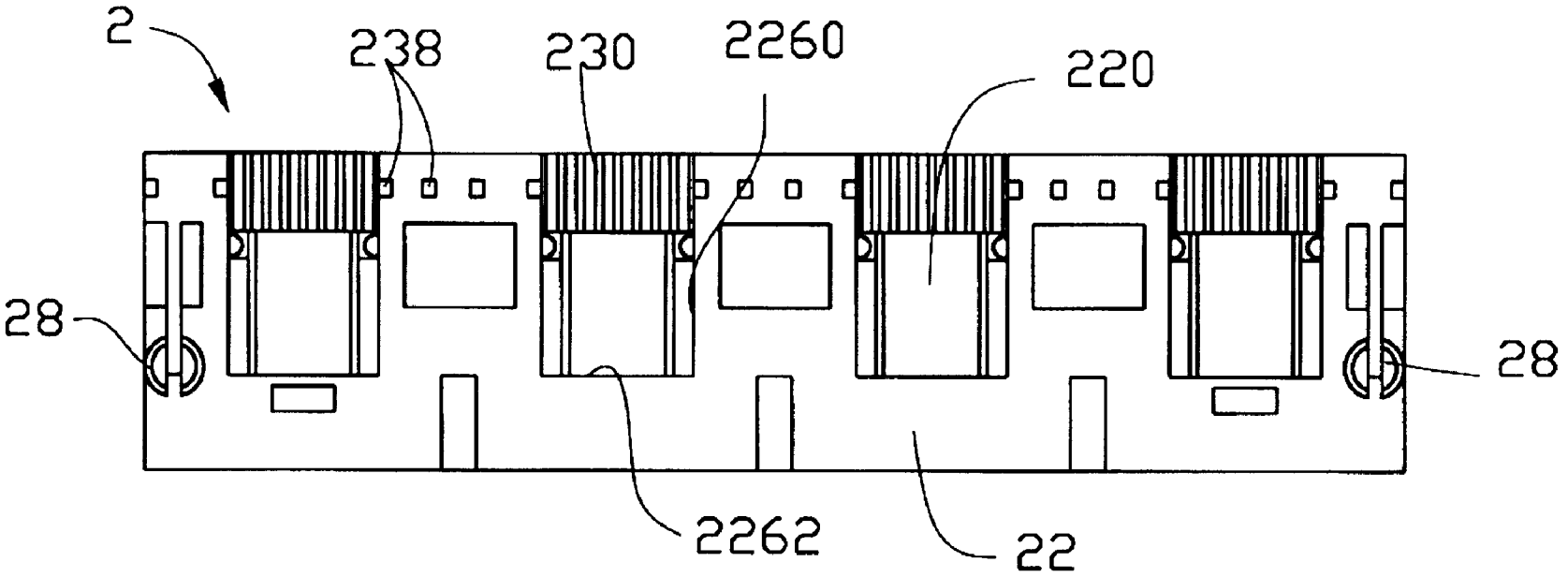
FIG. 3 is a bottom view of the housing shown in FIG. 1.
Figure 4:
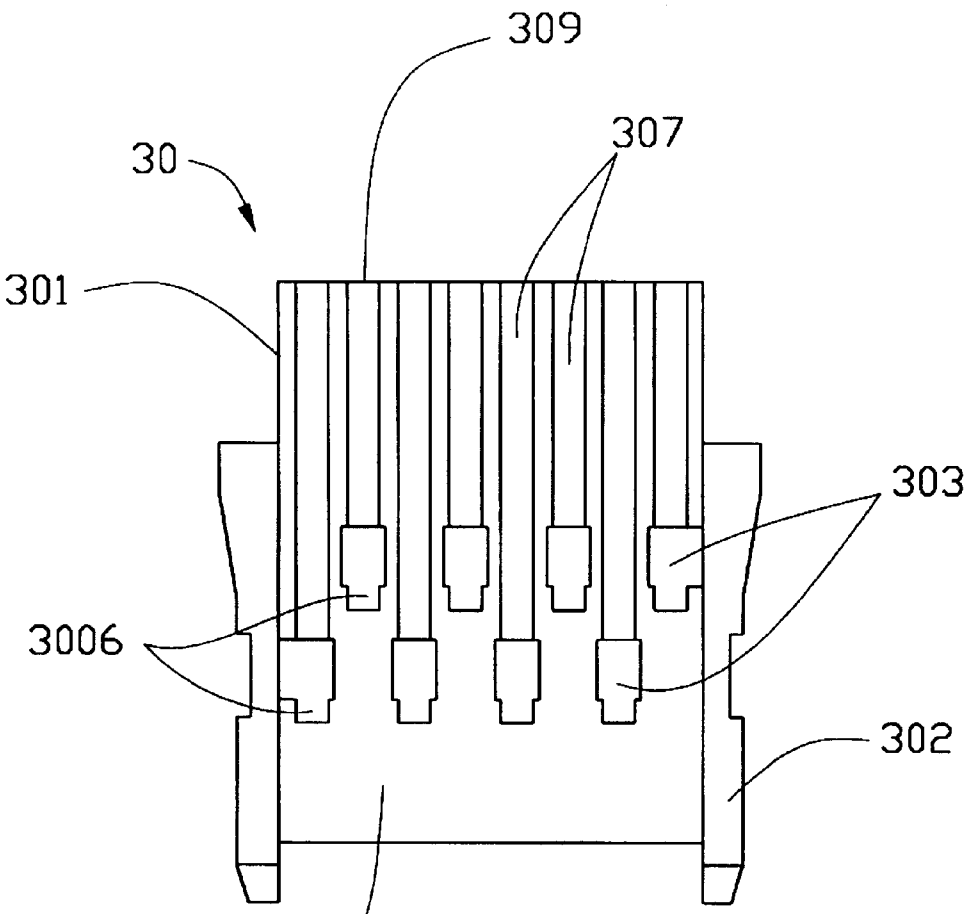
FIG. 4 is a bottom view of the spacer shown in FIG. 1.
Figure 6:
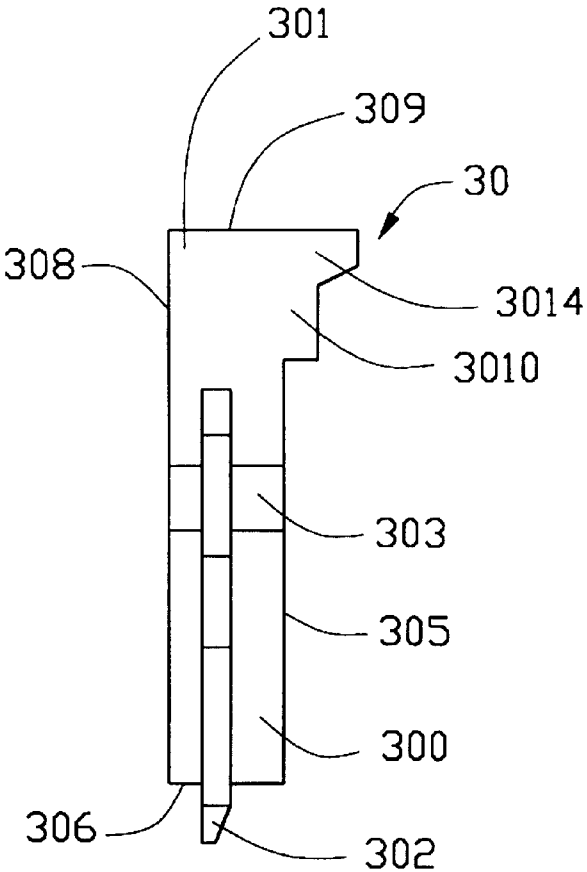
FIG. 6 is a side view of FIG. 5.
Figure 5:
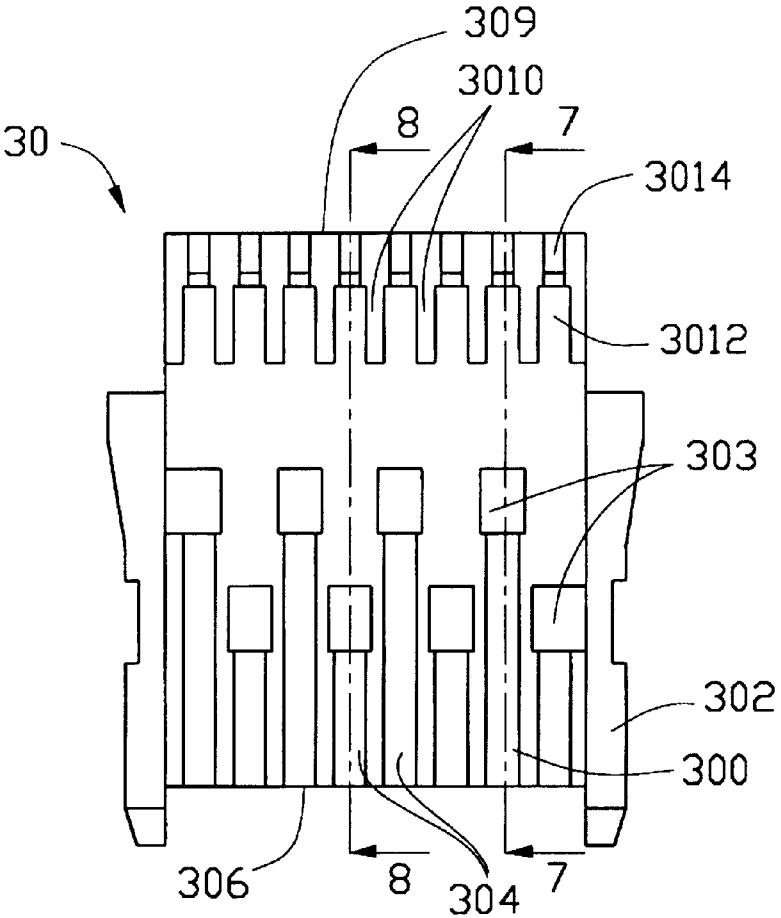
FIG. 5 is a top view of the spacer shown in FIG. 1.

Also referring to FIG. 3, the bottom wall 22 of the housing 2 defines four rearwardly exposed openings 220 in communication with the chambers 26. The opening 220 and a space 234 defined between the rear wall section 23 and the bottom wall 22 cooperatively define a receiving space for accommodating the spacer 30 of the insert module 3. A U-shaped groove 226 is defined in the bottom wall 22 in communication with the receiving space. The U-shaped groove 226 includes a pair of opposite side groove sections 2260 and a front groove section 2262 adjacent to the front opening 260. A pair of receiving holes 238 is provided on each side of the opening 220 in communication with the groove 202 in the upper surface 200 of the housing 2 for extension of the two terminals 40 of the LED 4 therethrough. A plurality of rearwardly extending second partitions 228 is formed above the front groove section 2262 in an orthogonal relationship relative to the first partitions 230 of the rear wall section 23.

Referring back to FIG. 1, the shield 6 comprises a front plate 60, an upper plate 62, an extension plate 64 extending rearward from the upper plate 62, a lower flange (not visible) rearwardly extending from a bottom edge 66 of the front plate 60, and a pair of opposite side plates 68 for cooperatively enclosing the housing 2. The front plate 60 comprises four openings 600 defined therein corresponding to the front openings 260 of the plug receiving chambers 26 of the housing 2, and a plurality of rearwardly extending spring fingers 602 (only one visible) stamped therefrom. The spring fingers 602 are adapted to be received in the corresponding recesses 240 of the lateral walls 24 of the housing 2 for biasing against inserted complementary modular plugs thereby retentively retaining the modular plugs in position. The front plate 60 further defines a plurality of holes 604 adjacent to a top edge thereof for exposing the LEDs 4. The extension plate 64 is connected with the upper plate 62 by a plurality of linkers 63. Each side plate 68 comprises a pair of tabs 682 outwardly stamped from a rear end portion 680 thereof. The extension plate 64 has a pair of side extensions 640 each with a pair of locking holes 642 defined therein corresponding to the tabs 682 of the side plate 68. Each of the side plate 68 and the extension plate 64 respectively has grounding pins 684, 644 for connecting with grounding traces on the PCB.

As shown in FIGS. 4–8, each spacer 30 includes a front body portion 300, a rear engaging portion 301, and a pair of latch arms 302 on opposite sides of the body portion 300. A plurality of clearance holes 303 is defined in the body portion 300 and arranged in two rows in a staggered manner. A plurality of upper slots 304 is defined in an upper surface 305 of the body portion 300 extending from a front end 306 of the body portion 300 to the clearance holes 303. The spacer 30 also defines a plurality of guiding slots 307 in a lower surface 308 thereof extending from the clearance holes 303 to a rear end 309 of the spacer 30. A plurality of horizontal holes 3002 is defined in a front end portion of the body portion 300 in communication with the clearance holes 303. A cutout 3004 is defined in the front end 306 of the body portion 300 to communicate the horizontal hole 3002 with the corresponding upper slot 304. A receiving hole 3006 is defined in the bottom surface 308 of the spacer 30 on a front side of the clearance hole 303 and in communication with the clearance hole 303 and the horizontal hole 3002.

The rear engaging portion 301 has a step-like structure to comprise a plurality of upwardly extending ribs 3010 with grooves 3012 defined therebetween in alignment with the upper slots 304. An upwardly extending projection 3014 is formed between each pair of adjacent ribs 3010 at a higher level relative to the ribs 3010 and located at the rear end 309 of the spacer 30.

Figure 7:
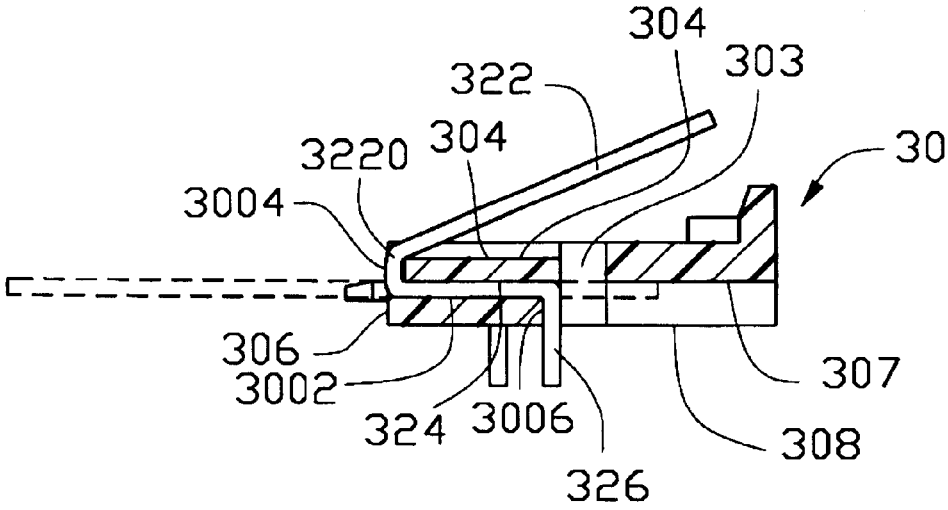
FIG. 7 is a cross-sectional view taken along line 7—7 of FIG. 5 with contacts loaded therein and shown in solid and dashed lines for illustrating the sequential loading process of the contacts.
Figure 8:
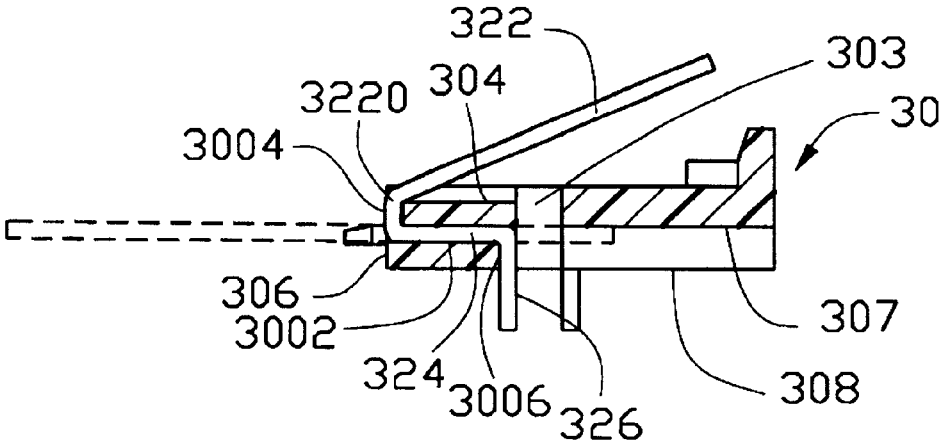
FIG. 8 is a cross-sectional view taken along line 8—8 of FIG. 5 with contacts loaded therein and shown in solid and dashed lines for illustrating the sequential loading process of the contacts.

As illustrated in FIGS. 7 and 8, each contact 32 includes an intermediate portion 324, an upwardly and rearwardly bent slanted spring contact portion 322 and a downwardly bent tail portion 326 extending from opposite ends of the intermediate portion 324. The slanted spring contact portion 322 further has a transition section 3220 connecting with the intermediate portion 324. The intermediate portion 324 of the contact 32 is received in the horizontal hole 3002 of the spacer 30, the transition section 3220 is accommodated in the cutout 3004 of the spacer 30, and the tail portion 326 is received in the receiving hole 3006 of the spacer 30 and downwardly extends therefrom.

Each contact 32 is loaded into the spacer 30 instead of the conventional insert molding process. As shown in phantom in FIGS. 7 and 8, each contact 32 is in a straight shape in an initial position. The straight contact 32 is guided along the guiding slot 307 of the spacer 30 into the aligned horizontal hole 3002 to project a predetermined distance from the front end 306 of the spacer 30. The projecting portion of the contact 32 is upwardly bent and then rearwardly bent to form the transition section 3220 received in the cutout 3004 and the slanted spring contact portion 322 above the upper slot 304. Preferably through a tool extending through the clearance hole 303, the rear portion received in the clearance hole 303 and the guiding slot 307 is downwardly bent to be received in the receiving hole 3006 to form the tail portion 326. In this loading process, the clearance holes 303 and the cutouts 3004 respectively facilitate the downward bending of the tail portions 326 and the upward and rearward bending of the spring contact portions 322.

In assembly, the insert modules 3 are first inserted into corresponding receiving spaces of the housing 2 from the rear end of the housing 2 and are retained therein by interferential engagement between the latch arms 302 thereof and opposite side groove sections 2260 of the U-shaped groove 226. The transition sections 3220 of the contacts 32 are retained between the second partitions 228 adjacent to the front openings 260 of the housing 2. The slanted spring contact portions 322 of the contacts 32 are received in a corresponding plug receiving chamber 26 of the housing 2 with free ends thereof retained in the receiving channels 232 between the first partitions 230 of the rear wall section 23. The engaging portion 301 of the spacer 30 is received in the space 234 defined between the first partitions 230 and the bottom wall 22 with the projections 3014 thereof received within spaces defined between free ends of the first partitions 230. Thus, the insert modules 3 are securely retained in the housing 2 with the spring contact portions 322 of the contacts 32 received in corresponding chambers 26 for connecting with mating contacts of inserted modular plugs and the tail portions 326 downwardly projecting from the bottom surface 220 of the housing 2 for being inserted into the PCB.

The LEDs 4 are received in the corresponding grooves 202 in the upper surface 200 of the housing 2 with the terminals 40 thereof downwardly extending through the receiving holes 238 of the housing 2 for being inserted into the PCB. The LEDs 4 are retained in position by the lockers 5 engaged with the housing 2. The shield 6 then encloses the housing 2 exposing the front openings 260 of the housing 2 and the LEDs 4. The extension plate 64 is downwardly bent to enclose the rear end of the housing 2. The side extensions 640 of the extension plate 64 overlap the rear end portions 680 of the side plates 68 with locking holes 642 thereof engaged with the corresponding tabs 682 of the side plates 68. The respective grounding pins 644, 684 of the extension plate 64 and the side plates 68 are connected with grounding traces on the PCB. Thus, the assembly of the multi-port modular jack assembly 1 of the present invention is completed.

Since the contacts 32 are loaded in the spacer 30 of the insert module 3 instead of the conventional insert molding method in accordance with the concepts of the present invention, the production cost is reduced and the assembling process is simplified thereby facilitating mass production.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing having top and bottom walls and opposed lateral walls defining a receiving cavity; and an insert module received in the receiving cavity and including a spacer and a plurality of contacts loaded in the spacer, each contact including an intermediate portion, an upwardly and rearwardly bent spring contact portion continuing one end of the intermediate portion and extending into the receiving cavity, and a downwardly bent tail portion continuing the other end of the intermediate portion, the spacer having an upper surface, a lower surface, a plurality of clearance holes distant from front and rear ends of the spacer, a plurality of horizontal holes for receiving the intermediate portions of the contacts, and a plurality of receiving holes at rear ends of and in communication with the horizontal holes for receiving the tail portions of the contacts, the clearance holes being located at rear ends of and in communication with the receiving holes thereby allowing a tool to extend therethrough for facilitating downward bending movement of the tail portions of the contacts; wherein the clearance holes of the spacer are arranged in two rows, each clearance hole of the first row being staggered from a corresponding clearance hole of the second row.

2. The electrical connector as described in claim 1, wherein the spacer defines a plurality of cutouts in front ends of and in communication with the horizontal holes for facilitating upward and rearward bending movement of the spring contact portions of the contacts.

3. The electrical connector as described in claim 2, wherein the upper surface of the spacer defines a plurality of upper slots in communication with the cutouts.

4. The electrical connector as described in claim 2, wherein the spring contact portion of the contact comprises a transition section connected with the intermediate portion, the transition section being received in the cutout of the spacer.

5. The electrical connector as described in claim 1, wherein the spacer defines a plurality of downwardly exposed guiding slots extending to the rear end of the spacer and in alignment with the horizontal holes for guiding the contacts into the horizontal holes.

6. The electrical connector as described in claim 1, wherein the spacer has latch arms on opposite sides thereof for engaging with the bottom wall of the housing.

7. The electrical connector as described in claim 6, wherein the bottom wall of the housing defines a rearwardly exposed opening for accommodating the spacer and a pair of opposite side grooves in communication with the opening for engaging with the latch arms of the spacer.

8. The electrical connector as described in claim 1, further comprising a shield for enclosing the housing.

9. The electrical connector as described in claim 1, further comprising a plurality of light emitting diodes received in grooves defined in the top wall of the housing, and a plurality of lockers engaged with the housing for retaining the diodes in position.

10. An insert module for an electrical connector comprising a spacer and a plurality of contacts loaded in the spacer, each contact including an intermediate portion, an upwardly and rearwardly bent spring contact portion and a downwardly bent tail portion respectively continuing opposite ends of the intermediate portion, the spacer having an upper surface, a lower surface, a plurality of clearance holes distant from front and rear ends of the spacer, a plurality of horizontal holes for receiving the intermediate portions of the contacts, and a plurality of receiving holes at rear ends of and in communication with the horizontal holes for receiving the tail portions of the contacts, the clearance holes being located at rear ends of and in communication with the receiving holes thereby allowing a tool to extend therethrough for facilitating downward bending movement of the tail portions of the contact; wherein the clearance holes of the spacer are arranged in two rows, each clearance hole of the first row being staggered from a corresponding clearance hole of the second row.

11. The insert module as described in claim 10, wherein the spacer defines a plurality of cutouts in front ends of and in communication with the horizontal holes for facilitating upward and rearward bending movement of the spring contact portions of the contacts.

12. The insert module as described in claim 11, wherein the upper surface of the spacer defines a plurality of upper slots in communication with the cutouts.

13. The insert module as described in claim 11, wherein the spring contact portion of the contact comprises a transition section connected with the intermediate portion, the transition section being received in the cutout of the spacer.

14. The insert module as described in claim 10, wherein the spacer defines a plurality of downwardly exposed guiding slots extending to the rear end of the spacer and in alignment with the horizontal holes for guiding the contacts into the horizontal holes.

15. The insert module as described in claim 10, wherein the spacer has latch arms on opposite sides thereof.

* * * * *